US006988452B2

(12) United States Patent
Vatsky

(10) Patent No.: US 6,988,452 B2
(45) Date of Patent: Jan. 24, 2006

(54) TOWER DISTRIBUTOR ASSEMBLY

(76) Inventor: Joel Vatsky, 501 Lindabury La., Pottersville, NJ (US) 07979

( * ) Notice: Subject to any disclaimer, the term of this patent is extended or adjusted under 35 U.S.C. 154(b) by 0 days.

(21) Appl. No.: 10/360,014

(22) Filed: Feb. 7, 2003

(65) Prior Publication Data

US 2003/0145769 A1 Aug. 7, 2003

Related U.S. Application Data

(60) Provisional application No. 60/355,676, filed on Feb. 7, 2002.

(51) Int. Cl.
*F23K 3/02* (2006.01)
*F23K 1/00* (2006.01)

(52) U.S. Cl. ..... 110/104 R; 110/106; 110/218

(58) Field of Classification Search ..... 110/232, 110/218, 342, 101 R, 106, 222, 219, 228, 110/258, 265, 292, 293, 303, 104 R; 366/101, 366/183.1, 336; 137/561 A
See application file for complete search history.

(56) References Cited

U.S. PATENT DOCUMENTS 684,153 A 10/1901 Wheildon
1,641,470 A * 9/1927 Bell ..... 110/104 R
1,875,934 A 9/1932 Sancton
1,911,543 A * 5/1933 Bailey ..... 406/183
2,146,618 A * 2/1939 Boudrant ..... 110/104 R
2,251,029 A 7/1941 Barton
3,267,891 A 8/1966 Hemker
4,570,549 A 2/1986 Trozzi
6,042,263 A 3/2000 Mentzer et al.

OTHER PUBLICATIONS

International Search Report mailed on Jul. 7, 2003.

* cited by examiner

*Primary Examiner*—Kenneth Rinehart
(74) *Attorney, Agent, or Firm*—Lerner, David, Littenberg, Krumholz & Mentlik, LLP

(57) ABSTRACT

A furnace system for solid fuel includes a tower distributor for addressing flow imbalance in a heterogeneous stream. The tower distributor comprises four sections: an inlet section, a mixer section, a recovery section and an outlet section. Illustratively, the inlet section includes a first elongated passageway where one, or more, input streams pass into the tower distributor. The mixer section receives the one, or more, input streams and mixes them together thereby creating turbulence while providing a single mixed stream to the recovery section. The recovery section includes an elongated passageway having a length sufficient for turbulence in the mixed heterogeneous stream to substantially subside as the mixed stream flows through the recovery section and exits to the outlet section as a laminar mixed stream. The outlet section provides the laminar mixed stream to multiple outlet pipes for transport to burners of the furnace system.

10 Claims, 5 Drawing Sheets

TOWER DISTRIBUTOR ASSEMBLY

CROSS-REFERENCE TO RELATED APPLICATIONS

This application claims benefit of U.S. Provisional Patent Application 60/355,676, filed Feb. 7, 2002, the disclosure of which is incorporated by reference herein.

BACKGROUND OF THE INVENTION

This invention relates generally to fuel burner systems and, more particularly, to solid fuel burner systems.

Many industrial processes require the equal distribution of heterogeneous flows to multiple receptors. For example in the electric utility industry, pulverized coal ("PC") is transported through a pipe (duct) system that connects a grinding mill to one, or more, burners of a furnace. The PC is transported within the pipe system by a carrier gas, e.g., air. Thus, the heterogeneous flow, or stream, is made up of the PC and air (i.e., a two-phase flow or multi-phase flow). Ideally, one grinding mill is capable of supplying one or more such streams to multiple burners (receptors) of the furnace.

Unfortunately, as a stream moves through a long length of pipe, the solid particles in the stream tend to concentrate together in a pattern generally characterized as being in the shape of a rope strand. This phenomenon is commonly referred to as roping, or laning. As such, any attempt to further distribute, or split, a stream into multiple streams for transport to respective receptors seldom, if ever, yields equal amounts of PC going to each of the receptors. In other words, when roping occurs in a stream, splitting that stream into multiple streams results in a flow imbalance between the multiple streams. This flow imbalance could be on the order of ±30% between the multiple streams.

Likewise, with respect to receptors fed by multiple sources, roping makes it difficult to combine the flows from these multiple sources such that each of the receptors are supplied with equal flows.

The prior art has attempted to resolve these problems in several ways. For example, the installation of adjustable orifices to each carrier pipe and adjusting the resistance through each orifice is one method to reduce the range of imbalances in the flow. This method, although helpful, does not provide predictable results in all cases.

More recently, on-line flow measurement devices have been developed that can provide real-time information on the relative coal and air flows in each pipe. The use of this monitoring equipment, in combination with the above-mentioned adjustable orifices, permits the measurement and modification of the flows. However, a significant limitation of this method is the requirement for continuous adjustments using complex computer-controlled algorithms.

As such, these and other methods are generally ineffective, both in cost, effort, and time, to rectify flow imbalance. Indeed, many methods suffer from the general inability to attain satisfactory flow balance and maintain flow balance over time; the inability to prevent high-pressure drop requiring excessive power consumption; and the inability to prevent nonlinear flow balance as flow quantity changes.

SUMMARY OF THE INVENTION

In view of the above flow balance problem, and in accordance with an aspect of the invention, a tower distributor assembly for use in a furnace system produces substantially equal multiple heterogeneous streams of solids in a carrier gas from either a single flow source or multiple flow sources.

In accordance with an embodiment of the invention, a tower distributor assembly comprises four sections: an inlet section, a mixer section, a recovery section and an outlet section. Illustratively, the inlet section includes a first elongated passageway where one, or more, input streams pass into the tower distributor assembly. The mixer section receives the one, or more, input streams and mixes them together to provide a single, turbulent, well-mixed (or homogeneous) stream to the recovery section. The latter includes a second elongated passageway having a length that is illustratively greater than or equal to one half of a diameter of the second elongated passageway. In particular, the length of the second elongated passageway is selected such that the length of time taken for the single, turbulent, well-mixed stream to travel through the recovery section provides enough time for the turbulent stream to settle such that the well-mixed stream exits the recovery section to the outlet section as a laminar flow. The outlet section divides the single, laminar, well-mixed stream for application to multiple outlet pipes for transport to the ultimate receptors.

In another embodiment, a furnace system comprises a grinding mill, a first pipe distribution system, the above-described tower distributor assembly, a second pipe distribution and multiple burners of a furnace.

In accordance with another aspect of the invention, a method produces equal well-mixed streams of solids in a carrier gas in a burner system. A first step comprises receiving in a first elongated passageway of an inlet section one, or more, input streams. A second step comprises mixing the received one, or more, input streams in a mixer section to provide a turbulent, well-mixed, stream. A third step comprises receiving the turbulent, well-mixed, stream in a recovery section such that movement of the well-mixed stream through the recovery section provides a single, laminar, well-mixed stream. A fourth step comprises applying the single, laminar, well-mixed stream to an outlet section for splitting the single, laminar, well-mixed stream for distribution to multiple receptors.

It is, therefore, an object of the present invention to provide a tower distributor assembly for use in a furnace system that will produce a single, laminar, homogeneous stream.

It is also an object of the present invention to provide a method that will produce substantially equal well-mixed streams in a furnace system.

Another object of this invention is to improve the distribution of the solid particles in a stream such that a stream is of more nearly equal weight and density.

Another object of this invention is to achieve substantially equal outlet streams that are derived from multiple unequal streams.

Another object of the present invention is to provide a cost effective means of achieving a single, laminar, homogeneous stream that relies substantially on pipe geometry and aerodynamics to effectively create a laminar homogeneous flow.

DETAILED DESCRIPTION

Other than the inventive concept, the apparatus and methods of a solid-fuel burner system are well known and are not described further herein. For example, other than the inventive concept, a burner may comprise a fuel injector, which is a portion of the combustion equipment that injects the fuels and carrier gas into a combustion zone of a furnace. Also, like numbers on different figures represent similar elements.

Figure 1:
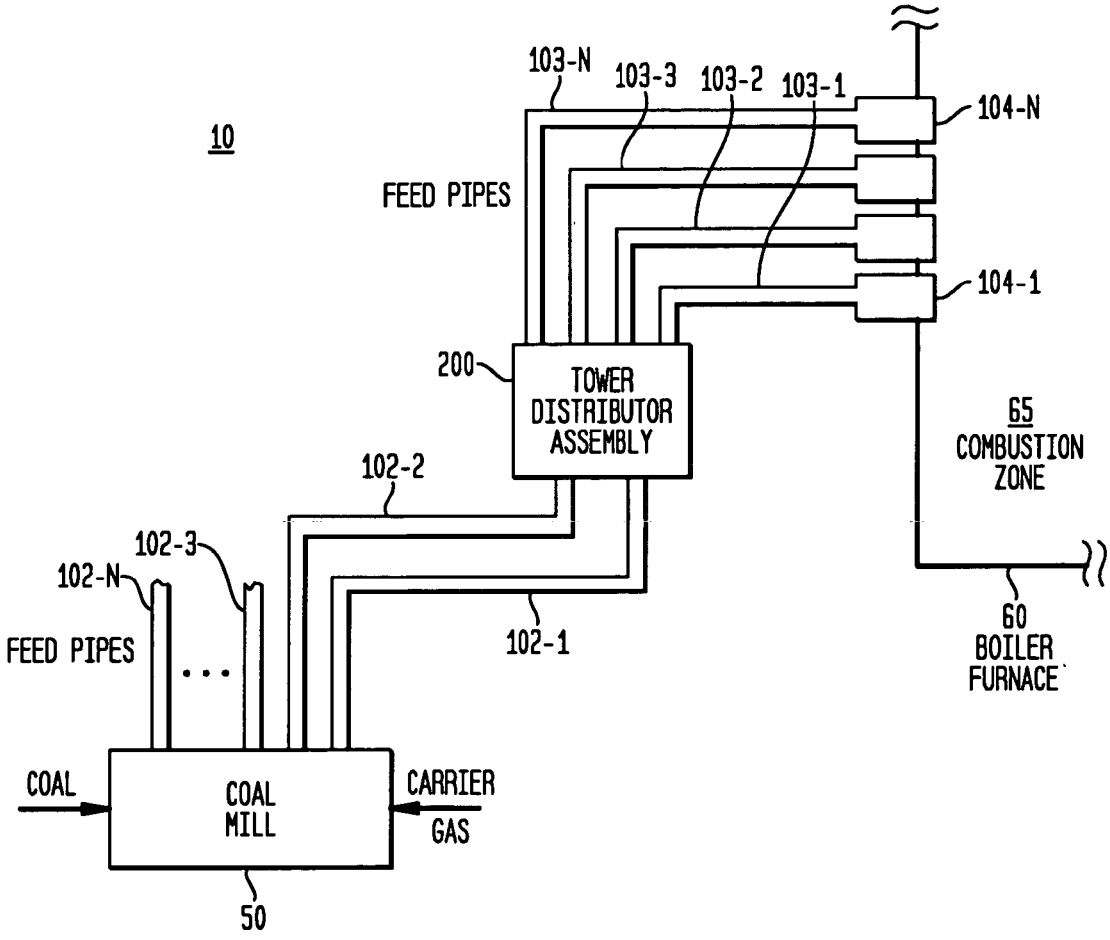
FIG. 1 is an illustrative block diagram of a burner system in accordance with the principles of the invention.

An illustrative block diagram of a burner system in accordance with the principles of the invention is shown in FIG. 1. Burner system 10 comprises a coal mill (fuel preparation plant or grinding mill) 50, a number of representative feed pipes (or just pipes), 102-1 to 102-N and 103-1 to 103-N, a tower distributor assembly 200, a number of burners as represented by burners 104-1 to 104-N, and a boiler furnace, of which a portion 60 is shown (hereafter boiler furnace 60) having a combustion zone 65. For simplicity, the inventive concept is described in the context of feed pipes 102-1, 102-2, 103-1, 103-2, 103-3 and 103-N and burners 104-1, 104-2, 104-3 and 104-N. However, the inventive concept is not so limited and may apply to any number and combination of feed pipes and burners.

Illustratively a solid fuel, e.g., coal, and a transport medium (or carrier gas) (e.g., air) are provided to a fuel preparation plant as represented by coal mill 50, which pulverizes the coal for distribution via the carrier gas to a number of burners (or receptors). This distribution initially occurs via feed pipes 102-1 to 102-N. As noted above, as a stream moves through a long length of pipe, the phenomenon of roping occurs. As such, any attempt to further distribute, or split, for example the stream in pipe 102-1 to pipes 103-1 and 103-2 for transport to burners 104-1 and 104-2, respectively, will typically result in a flow imbalance between the streams in pipes 103-1 and 103-2. Therefore, and in accordance with the principles of the invention, a tower distributor assembly 200 is used to mix the input streams (or input stream, for that matter) such that further division, or splitting, of the input streams into a number of output streams results in substantially equal distribution of the solid fuel among the output streams. That is, the output streams are flow balanced. To this extent, and as described further below, tower distributor assembly 200 illustratively combines and mixes the streams transported by pipes 102-1 and 102-2, and then divides the combined mixed stream to provide multiple flow-balanced output streams for transport to burners 104-1 to 104-N, via pipes 103-1 to 103-N, respectively. Burners 104-1 to 104-N provide these output streams to combustion zone 65 of boiler furnace 60 for combustion therein.

Figure 2:
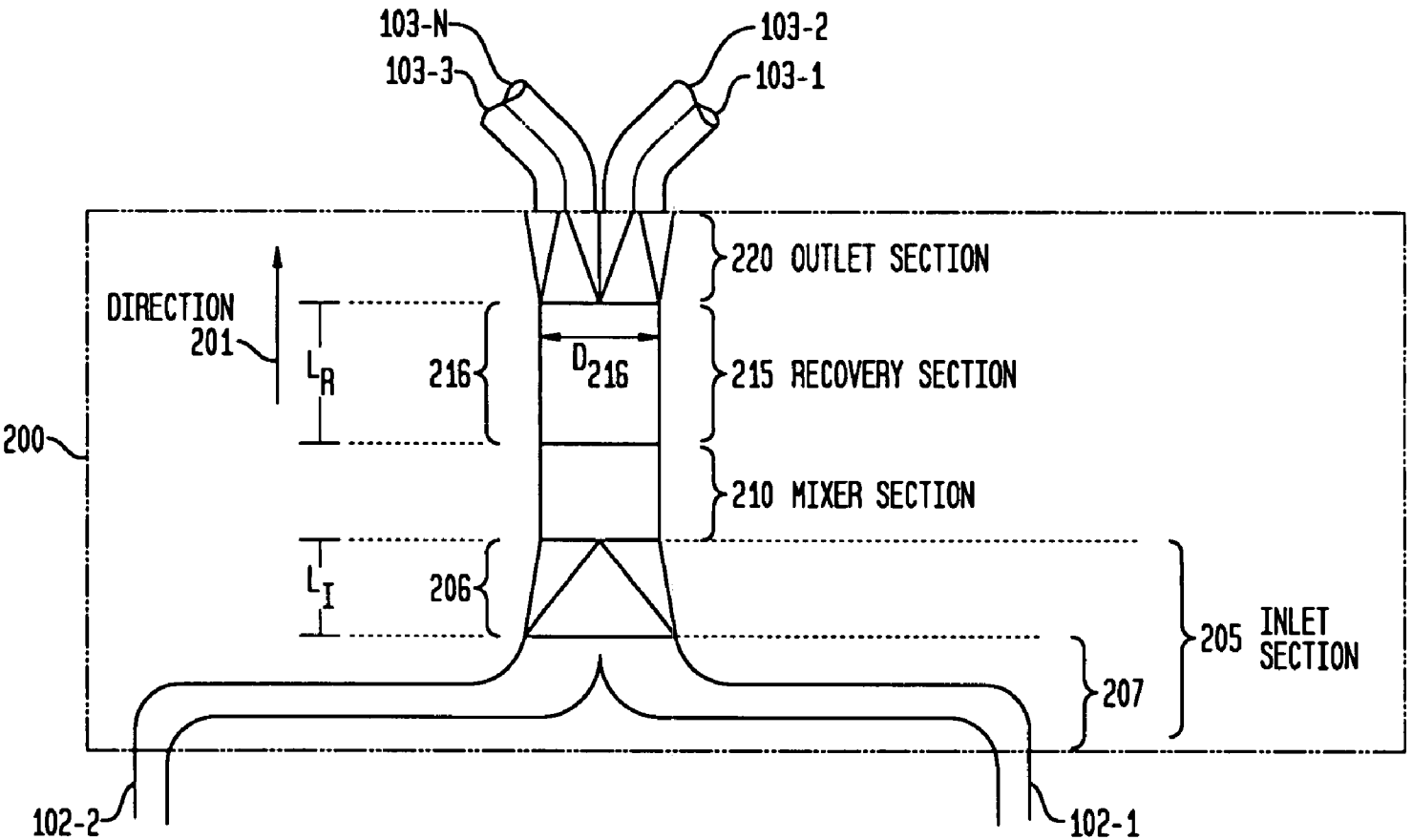
FIG. 2 is a side view of an illustrative embodiment of a tower distributor assembly in accordance with the principles of the invention for use in the burner system of FIG. 1.

Turning now to FIG. 2, an illustrative side view of tower distributor assembly 200 of FIG. 1 is shown. Tower distributor assembly 200 comprises four sections: an inlet section 205, a mixer section 210 (or mixer 210), a recovery section 215 and an outlet section 220. The direction of fuel flow in FIG. 2 is represented by arrow 201. Illustratively, the overall shape of tower distributor 200 is generally of a cylindrical form.

Figure 3:
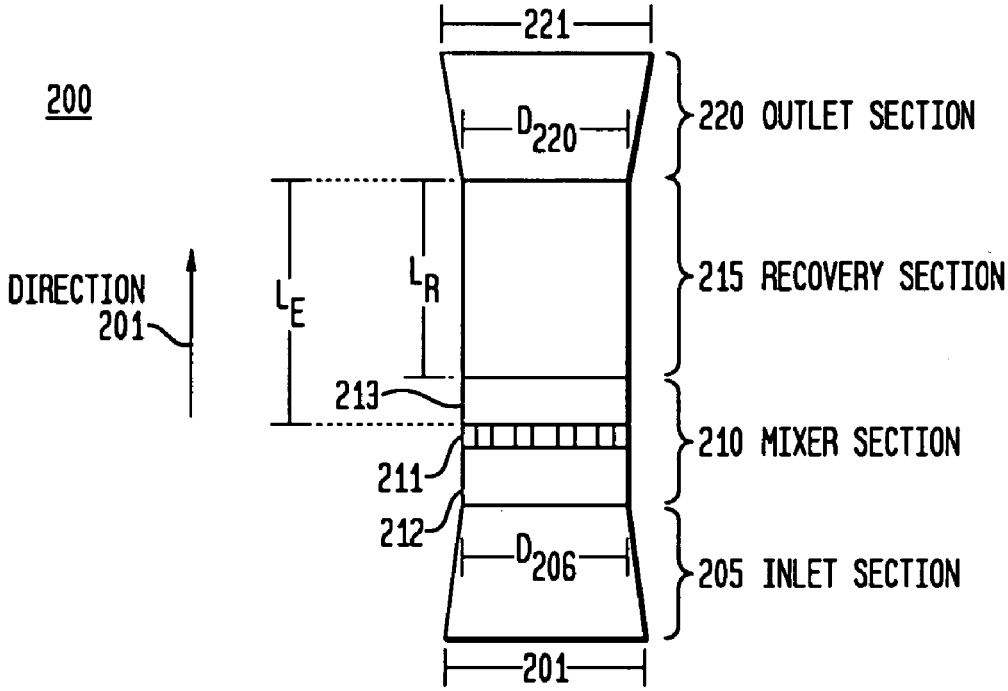
FIG. 3 is another side view of the tower distributor assembly of FIG. 2.
Figure 6:
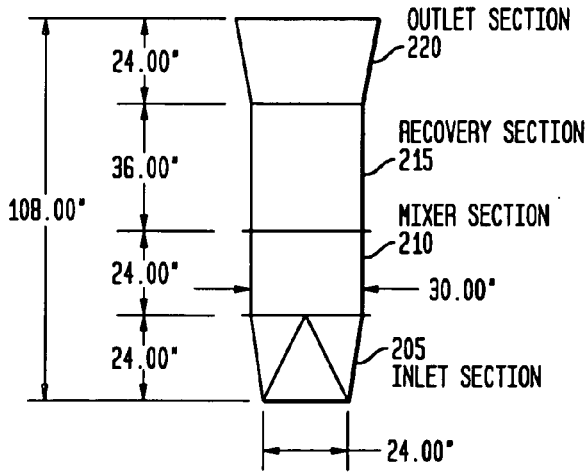
FIGS. 6 and 7 are other illustrative embodiments of a tower distributor assembly in accordance with the principles of the invention.

Inlet section 205 includes a first elongated passageway 206 and a transition section 207. Inlet section 205 is where one, or more, input streams pass into the tower distributor assembly. The first elongated passage way 206 has a length, $L_I$, in the direction of arrow 201 and a circular cross-section having a diameter $D_{206}$ (shown in FIG. 3). The diameter $D_{206}$ is also referred to herein as an outlet diameter of the inlet section. Preferably, the length of the first elongated passage way 206 is less than or equal to two times the diameter $D_{206}$. In this example, inlet section 205 is coupled to pipes 102-1 and 102-2 via transition section 207. The latter combines the streams from these pipes to provide a single stream to the first elongated passageway 206. Transition section 207 provides a square, or rectangular, to circular transition to match the circular cross-section of elongated passage way 206 with the typically non-circular connecting pipes. It should be noted that this type of transition section is not required for the inventive concept and merely provides the ability to match different geometries that may be found in the pipe distribution system. To facilitate this transition, a diameter 201 (shown in FIG. 3) of inlet section 205 may be larger, or less than, $D_{206}$ of inlet section 205 (a larger diameter is illustrated in FIG. 3, while a smaller diameter is illustrated in FIG. 6). The diameter 201 is also referred to herein as an inlet diameter of the inlet section.

The mixer section 210 receives the one, or more, input streams and mixes them together to provide a single, turbulent, well-mixed (or homogeneous) stream to the recovery section 215. Illustratively, mixer section 210 includes a diffuser, which is known in the art. For example, an illustrative diffuser is shown and described in U.S. Pat. No. 6,042,263 issued Mar. 28, 2000 to Mentzer et al. However, other types of turbulence inducing devices or elements can be used in the mixer section. Indeed, it is only necessary in the mixer section to mix the stream. As such, any turbulence inducing device can be used, e.g., an impeller, and the turbulence inducing device may be further determined by cost, size and material considerations.

Turning briefly to FIG. 3, mixer section 210 comprises a diffuser element 211, such as that described in the above-mentioned U.S. Pat. No. 6,042,263. Adjacent diffuser element 211 are diffuser regions 212 and 213. Diffuser element 211 is preferably located midway along a length of diffuser 215 in the direction of arrow 201 such that the lengths of diffuser regions 212 and 213 in the direction of arrow 201 are substantially equal. However, diffuser element 211 may be located anywhere along the length of mixer section 210 and, as such, the lengths of diffuser regions 212 and 213 can vary. Diffuser region 212 receives the single stream from inlet section 205 and provides this single stream to diffuser element 211. The latter induces turbulence into the stream to provide a single, turbulent, well-mixed stream to diffuser region 213 for application to recovery section 215. Preferably, a length of mixer section 210 is less than, or equal to, a diameter (not shown), $D_{210}$, of mixer section 210.

It should be appreciated that reference numeral 211 as shown in FIG. 3 is intended to generically represent various mixing devices other than a diffuser.

Turning back to FIG. 2, recovery section 215 is located downstream of mixer section 210 and includes a second elongated passageway 216 having a length (in the direction of arrow 201), $L_R$, that is illustratively greater than or equal to one half of a diameter, $D_{216}$, of the second elongated passageway 216. In particular, and in accordance with an aspect of the invention, the length of the second elongated passageway 216 is selected such that the length of time taken for the single, turbulent, well-mixed stream to travel through recovery section 215 provides enough time for the turbulent stream to substantially settle, or substantially subside, such that the well-mixed stream exits recovery section 215 to the outlet section 220 as a substantially laminar flow. It should be noted that the length of diffuser region 213 in the direction of flow may also affect the stream. As such, an effective recovery section length $L_E$ is defined as shown in FIG. 3 for the second elongated passageway. Length $L_E$ includes the length of recovery section 215, $L_R$, and a length of diffuser region 213 in the direction of flow. In this case, length $L_E$ is illustratively greater than or equal to one half of $D_{216}$. As such, as used herein the term "length of the recovery section" may also include the length $L_E$.

Figure 4:
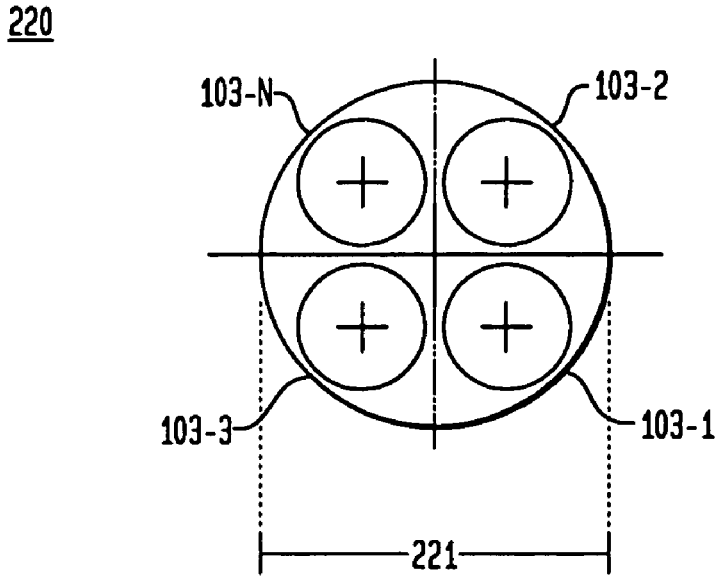
FIG. 4 is a top view of the tower distributor assembly of FIG. 2.

Outlet section 220 separates, splits, or divides the stream (or flow) leaving recovery section 215 into multiple outlets. In this example, outlet section 220 receives the single, laminar, well-mixed stream from recovery section 215 and divides this stream for application to four outlet pipes (103-1, 103-2, 103-3 and 103-N) for transport to the ultimate receptors (burners 104-1, 104-2, 104-3 and 104-N). Since, the stream from recovery section 215 is a laminar, well-mixed (or homogeneous) stream—the splitting of this stream into multiple output streams does not suffer from flow imbalance. Outlet section 220 includes a conical frustrum with internal separators. The internal separators segregate the two-phase flow leaving the recovery section into the desired number of flow streams and channel them into the respective outlet pipes. Preferably, a length of outlet section 220 in the direction of arrow 201 is less than or equal to two times a diameter, $D_{220}$, of outlet section 220 (shown in FIG. 3). The diameter $D_{220}$ is also referred to herein as an inlet diameter of the outlet section. Like inlet section 205, outlet section 220 also serves as a transition section. As such, to facilitate this transition, a diameter 221 of outlet section 220 may be larger, or less than, inlet diameter $D_{220}$ of outlet section 220 (illustrated in FIG. 3). As used herein, the diameter 221 is also referred to as the outlet diameter of the outlet section. A top view of outlet section 220 of tower distributor 200 is further illustrated in FIG. 4.

As described above, a tower distributor assembly receives multiple multi-phase streams, combines them into a single stream, mixes the single stream to provide a turbulent single stream, converts the turbulent single stream into a laminar single stream and then splits the laminar single stream into multiple output streams, where each output stream has substantially the same amount of solid fuel as the other output streams. Thus, avoiding the problem of flow imbalance between streams as described earlier.

Figure 5:
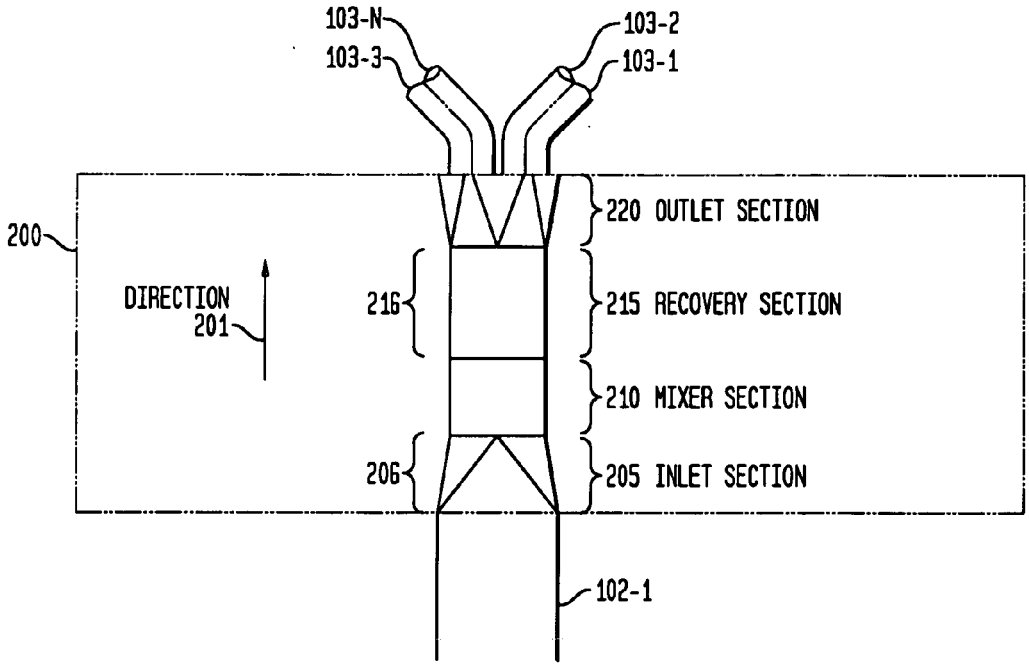
FIG. 5 is a side view of another illustrative embodiment of a tower distributor assembly in accordance with the principles of the invention.

As can be observed from FIGS. 1, 2 and 3, the tower distributor assembly receives multiple input streams. However, the tower distributor assembly may also receive a single stream for distribution to multiple receptors. This is illustrated in FIG. 5 showing single feed pipe 102-1 providing an input stream to tower distributor assembly 200. Like numbers on different figures represent similar elements to those described above and are not described further herein.

Figure 7:
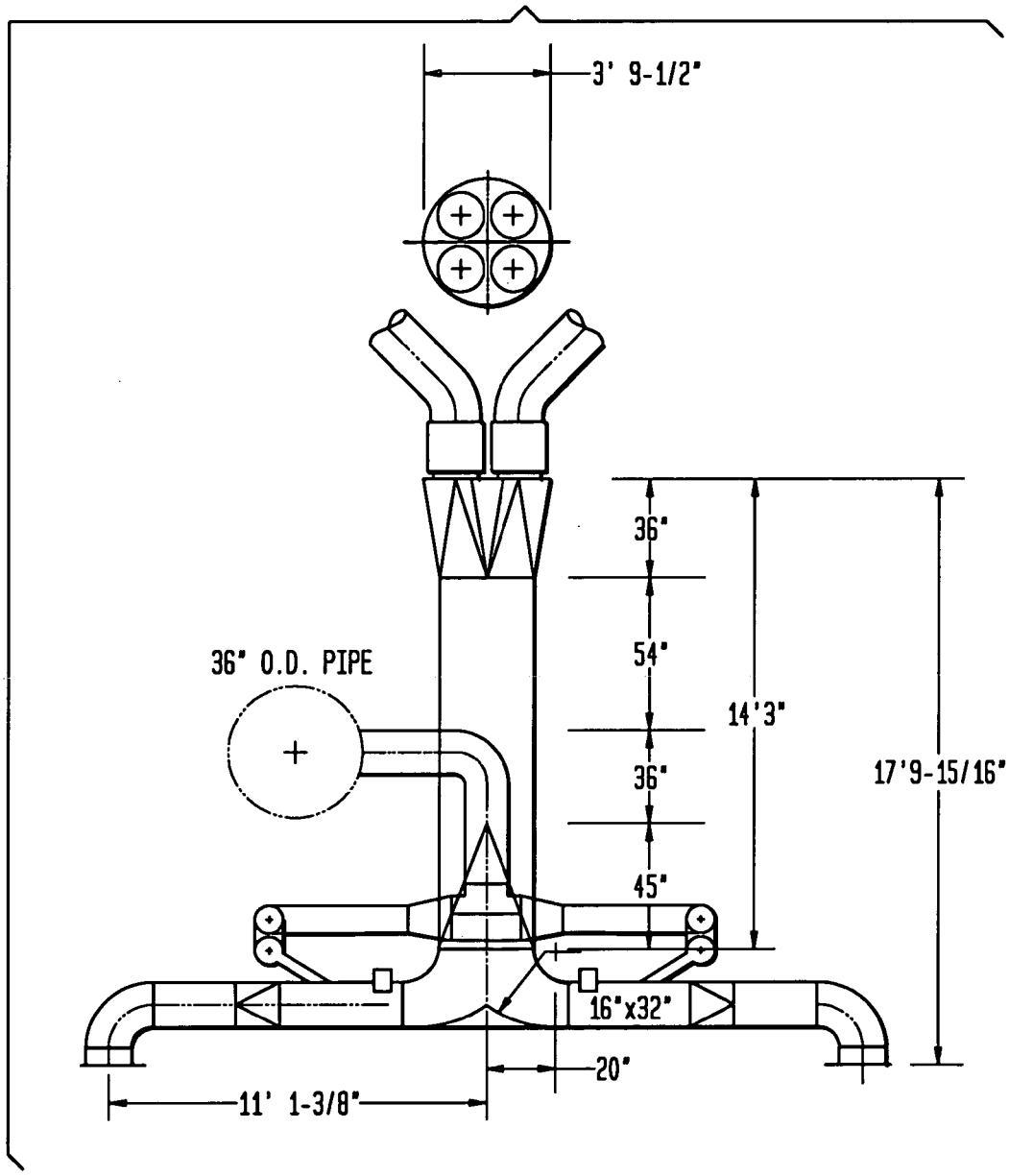

Other variations of a tower distributor assembly in accordance with the principles of the invention are shown in FIGS. 6 and 7. These figures also show some illustrative dimensions (in inches).

Although the invention herein has been described with reference to particular embodiments, it is to be understood that these embodiments are merely illustrative of the principles and applications of the present invention. For example, although the inventive concept was described in the context of a single solid fuel burner system, the inventive concept is also applicable to cofiring burner systems, e.g., having a primary solid fuel and a secondary solid fuel. Also, although the cross-section of the tower distributor assembly was described as being circular for ease and simplicity of manufacture, the cross-section of the tower distributor assembly may have other shapes, such as, but not limited to, a polygon. Similarly, although described in the context of a tower distributor assembly having four sections, there may be additional sections. It is therefore to be understood that numerous modifications may be made to the illustrative embodiments and that other arrangements may be devised without departing from the spirit and scope of the present invention as defined by the appended claims.

What is claimed is:

1. A furnace system comprising:

a furnace;

at least one feed pipe for providing at least one heterogeneous stream comprising at least one solid fuel and a carrier gas;

a tower distributor coupled to the at least one feed pipe for receiving the at least one heterogeneous stream and for distributing the at least one heterogeneous stream into a plurality of output streams, each of the plurality of output streams having substantially equal amounts of the at least one solid fuel;

a plurality of burners coupled to the furnace for receiving each of the plurality of output streams for combustion in the furnace;

wherein the tower distributor includes an inlet section for receiving the at least one heterogeneous stream comprising at least one solid fuel and a carrier gas;

a mixer section including a mixing device coupled to the inlet section for creating turbulence and mixing the at least one heterogeneous stream to provide a single mixed stream;

a recovery section arranged downstream of the mixer section for receiving the single mixed heterogeneous stream, the recovery section having a length such that turbulence in the single mixed heterogeneous stream substantially subsides as the stream flows therealong, whereby a laminar mixed heterogeneous stream is obtained; and an outlet section for receiving the laminar mixed heterogeneous stream and for splitting the laminar mixed heterogeneous stream into a plurality of output streams such that the plurality of output streams have substantially equal amounts of the at least one solid fuel.

2. The furnace system of claim 1, wherein the length of the recovery section is at least one-half of the dimension of the diameter thereof.

3. The furnace system of claim 1, wherein the mixer device includes a diffuser.

4. The furnace system of claim 1, wherein the mixer device includes an impeller.

5. The furnace system of claim 1, wherein the length of the recovery section is greater than the length of the mixer section.

6. The furnace system of claim 1, wherein the tower distributor is coupled to the at least one feed pipe at the inlet section.

7. The furnace system of claim 6, wherein the inlet section includes a transition section having a geometry that matches the geometry of the at least one feed pipe.

8. The furnace system of claim 7, wherein the recovery section includes a length that is greater than the length of the mixer section.

9. The furnace system of claim 6, wherein the inlet section further comprises an inlet diameter and an outlet diameter, wherein the inlet diameter is greater than the outlet diameter.

10. The furnace system of claim 1, wherein the outlet section further comprises an inlet diameter and an outlet diameter, wherein the inlet diameter is greater than the outlet diameter.

* * * * *